US012734462B2

(12) United States Patent
Eck

(10) Patent No.: US 12,734,462 B2
(45) Date of Patent: Sep. 15, 2026

(54) GRAVITY-ASSISTED ATTRACTION SHOW SYSTEMS AND METHODS

(71) Applicant: Universal City Studios LLC, Universal City, CA (US)

(72) Inventor: Timothy J. Eck, Windermere, FL (US)

(73) Assignee: Universal City Studios LLC, Universal City, CA (US)

( * ) Notice: Subject to any disclaimer, the term of this patent is extended or adjusted under 35 U.S.C. 154(b) by 273 days.

(21) Appl. No.: 18/675,725

(22) Filed: May 28, 2024

(65) Prior Publication Data

US 2025/0367571 A1 Dec. 4, 2025

(51) Int. Cl.

| | |
|---|---|
| ***A63J 21/00*** | (2006.01) |
| ***A63J 1/02*** | (2006.01) |
| ***A63J 5/02*** | (2006.01) |
| ***A63J 5/04*** | (2006.01) |

(52) U.S. Cl.

CPC ..... *A63J 21/00* (2013.01); *A63J 1/02* (2013.01); *A63J 5/023* (2013.01); *A63J 5/025* (2013.01); *A63J 5/04* (2013.01)

(58) Field of Classification Search

CPC ..... A63J 21/00; A63J 1/02

See application file for complete search history.

(56) References Cited

U.S. PATENT DOCUMENTS

| | | | |
|---|---|---|---|
| 7,938,540 | B2 | 5/2011 | Brentnall, III et al. |
| 8,262,226 | B2 | 9/2012 | LaDuke et al. |
| 8,328,361 | B2 | 12/2012 | O'Connell et al. |
| 8,915,595 | B2 | 12/2014 | O'Connell et al. |
| 9,849,399 | B2 | 12/2017 | Crowder et al. |
| 11,235,258 | B2 | 2/2022 | Brister |
| 11,899,348 | B2 | 2/2024 | Krauthamer |
| 2023/0302372 | A1 | 9/2023 | Deuel et al. |
| 2024/0157264 | A1 | 5/2024 | Goergen et al. |
| 2025/0278879 | A1 | 9/2025 | Ayala, Jr. et al. |

OTHER PUBLICATIONS

PCT/US2025/026830 International Search Report and Written Opinion mailed Aug. 5, 2025.

*Primary Examiner* — Yingchuan Zhang
(74) *Attorney, Agent, or Firm* — Fletcher Yoder, P.C.

(57) ABSTRACT

An attraction system of an amusement park includes an observation area, a primary area, a primary real object, a reflective component positioned to create a reflection of the primary real object, and a secondary area. The controller is configured to release the primary real object, wherein the reflective component reflects imagery of the primary real object in motion, thereby creating a virtual object that appears to be moving toward a guest within the secondary area.

20 Claims, 8 Drawing Sheets

GRAVITY-ASSISTED ATTRACTION SHOW SYSTEMS AND METHODS

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Special effects within amusement parks or other entertainment venues aid in immersing guests in an experience. For example, an immersive environment may include three-dimensional (3D) props and set pieces, robotic or mechanical elements, and/or display surfaces that present media. In addition, the immersive environment may include visual effects, audio effects, smoke effects, and/or motion effects. As such, the immersive environment may include a combination of dynamic and static elements. It is presently recognized that more creative special effects are desirable, such as to provide an attraction with more complex, immersive, and/or realistic special effects.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, an attraction system of an amusement park is provided. The attraction system includes an observation area, a primary area, a primary real object, and a reflective component. The primary real object is vertically suspended in the primary area via a suspension system. The reflective component is angled to reflect the primary real object to provide an illusion of a virtual object in the secondary area from a perspective of one or more guests in the observation area.

In an embodiment, an attraction system of an amusement park is provided. The attraction system includes a reflective component, a primary area, a primary real object, and a control system. The primary area is positioned vertically above the reflective component. The primary real object is positioned in the primary area. The control system may instruct actuation of the primary real object in the primary area to enable the primary real object to accelerate in the primary area toward the reflective component to provide an illusion of a virtual object in motion in a secondary area from a perspective of one or more guests in the observation area.

In an embodiment, a method of operating an attraction system is provided. The method includes operating, via a control system, a suspension system to release a primary real object to cause the primary real object to accelerate due to gravity from a first position in a primary area toward a second position in the primary area. The method also includes generating, via a reflective component, a reflection of the primary real object as the primary real object accelerates due to gravity from the first position in the primary area toward the second position in the primary area to provide an illusion of a virtual object in motion in a secondary area from a perspective of one or more guests in an observation area.

BRIEF DESCRIPTION OF DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
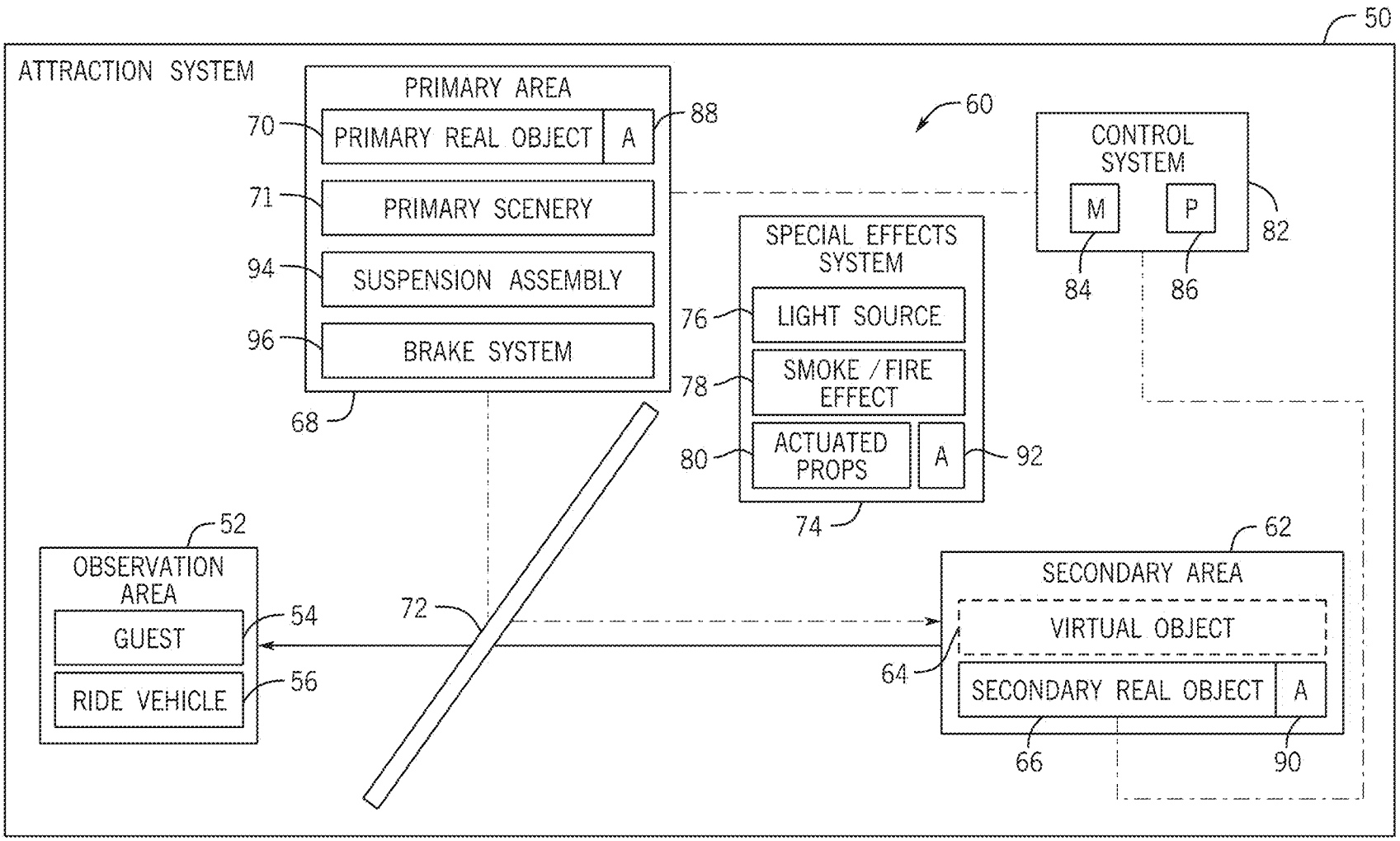
FIG. 1 is a schematic diagram of an attraction system, in accordance with the embodiments described herein.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure relates to an attraction system, such as a ride attraction in which guests are carried in ride vehicles through the ride attraction and/or a walk-through attraction in which the guests walk through the walk-through attraction. In an embodiment, the attraction system uses a show effect system, wherein actuation is utilized to release (e.g., drop) a primary real object within a primary area. Further, the show effect system incorporates a reflective component (e.g., opaque, fully reflective component) to reflect the primary real object as it is released (e.g., dropped) within the primary area. As such, the guests may observe a reflection of the primary real object as it is released (e.g., dropped) within the primary area, wherein the reflection of the primary real object may appear to the guests as an object accelerating toward the guests.

In an embodiment, the attraction system uses a show effect system, wherein actuation is utilized to release (e.g., drop) a primary real object within a primary area. Further, the show effect system incorporates a reflective component (e.g., beam splitter) to reflect the primary real object as it is released (e.g., dropped) within the primary area. In this case, the guests may observe a reflection of the primary real object as it is released (e.g., dropped) within the primary area, as well as view a secondary area through the reflective component. Accordingly, the primary real object and the secondary area may appear combined, superimposed, or overlaid with respect to one another via the reflective component. For example, the primary real object may appear to move within or travel through the secondary area from a perspective of the guests as the primary real object is released within the primary area. Additionally, or alternatively, the show effect system may include a special effects system (e.g., light source, smoke effect, actuated objects, such as actuated doors) that adds to an immersive experience for the guests. For example, the show effect system may provide lighting to realistically portray the primary real object as present within the secondary area, such that the guests perceive the primary real object as physically present within the secondary area.

In an embodiment, the primary area may be elevated and positioned such that it is not directly visible to the guests. For example, the primary area may be positioned vertically above the reflective component, which is laterally offset from the guests. The primary real object may be suspended using, for example, a pulley (e.g., sheave) system with a cable. The cable may be any suitable wire, rope, chain, and/or cable structure. In an embodiment, the cable may conduct electricity to animate the primary real object, such as to drive movement of one portion of the primary real object relative to another portion of the primary real object. The primary real object may be dropped within the primary area such that the primary real object is in free fall (e.g., falls due to gravity, in motion, exhibits a velocity, is accelerating). It should also be appreciated that the primary real object may be dropped or moved through the primary area in a controlled manner (e.g., not in free fall) via a linear actuator, a rotary actuator, or any other suitable actuator. The primary real object may be reset by repositioning the primary real object from a final position to an initial position within the primary area for a next show.

The primary real object within the primary area is reflected by the reflective component. The reflective component may be angled to reflect the primary real object that is positioned within the primary area to create the reflection (e.g., also referred to herein as virtual imagery or a virtual object) that is observable by the guests. The reflective component may be angled to create an illusion for the guests, where the primary real object appears to be moving toward the guests. The free fall of the primary real object can be stopped using deceleration techniques (e.g., fin brakes, eddy current brakes, magnetic brakes). In general, use of free fall provides advantages, as it leverages gravity to obtain speeds and or accelerations that would otherwise be difficult and/or costly to implement. Further, the attraction system described herein may utilize a vertical space to provide the illusion of the primary real object moving through a horizontal space (e.g., a virtual horizontal space or a real horizontal space) toward the guests, which may enable use of compact structures for areas with limited floor space, for example.

With the preceding in mind, FIG. 1 is a schematic diagram of an embodiment of an attraction system 50 that may be utilized in an amusement park or other entertainment venue. The attraction system 50 may include an observation area 52 where one or more guest(s) 54 of the attraction system 50 may be positioned. As an example, the observation area 52 may include a portion of a path (e.g., a walkway, a queue, a line, a track) through which the guest(s) 54 may navigate. As shown in FIG. 1, a ride vehicle 56 may move (e.g., carry) the guest(s) 54 along the path to reach the observation area 52. As another example, the observation area 52 may include a space (e.g., a seating area) where the guest(s) 54 may be positioned to view a show.

Furthermore, the attraction system 50 may include a show effect system 60 that may provide entertainment to the guest(s) 54 located in the observation area 52. For example, the show effect system 60 may create visual effects that are viewable by the guest(s) 54. In an embodiment, the show effect system 60 may include a secondary area 62 that the guest(s) 54 may view from the observation area 52. As described herein, the secondary area 62 may be a virtual secondary area (e.g., an apparent secondary area, not physically present or real, such as a reflection of a primary scenery 71 within a primary area 68) or a real secondary area (e.g., a physical secondary area, physically present and real). As an example, the secondary area 62 may include or enable the guest(s) 54 to visualize a virtual object 64, which may be a reflection that may be viewed via a reflective component 72 (e.g., a fully reflective material (e.g., opaque) or beam splitter (e.g., non-opaque). In particular, when the reflective component 72 is a fully reflective material (e.g., opaque), the secondary area 62 is a reflection of the primary area 68, which includes a primary real object 70 and the primary scenery 71, thereby creating a virtual secondary area. The primary scenery 71 may include a scene (e.g., decorative walls, structures) to complement the primary real object 70. In this way, the guest(s) 54 visualize the virtual object 64 within the secondary area 62 (e.g., virtual secondary area) due to the reflection provided by the reflective component 72 that includes the fully reflective material. Accordingly, while certain examples herein describe certain features and effects related to the virtual object 64 when the reflective component 72 is the fully reflective material to facilitate discussion, it should be appreciated that with the fully reflective material the virtual object 64 as the reflection of the primary object 70 is accompanied by or visible with the secondary area 62 (e.g., virtual secondary area) as the reflection of the primary scenery 71 in the primary area 68. Further, when the reflective component 72 is a beam splitter (e.g., non-opaque), the secondary area 62 is the real secondary area and the guest(s) 54 visualize the virtual object 64 as the reflection provided by the reflective component 72 that includes the beam splitter. In an embodiment, when the secondary area 62 is the real secondary area, the real secondary area may also include a hallway or corridor with a secondary real object 66 (e.g., a performer, a prop).

The show effect system 60 may also include a primary area 68 that may not be directly visible to the guest(s) 54 from the observation area 52. A primary real object 70 may move within the primary area 68, and the primary real object 70 may be reflected by a reflective component 72 to be visible to the guest(s) 54 to provide an immersive experience for the guest(s) 54. In an embodiment, the secondary real object 66 and/or the primary real object 70 may be actuated through electrical wiring. For example, the primary real object 70 may be supported by a suspension assembly 94 (e.g., suspension system), such as a structural cable (e.g., wire, rope, cable). In an embodiment, the structural cable may include electrical conductors (e.g., electromechanical cable; in parallel; within or wrapped; in the same path). The electrical conductors allow signal(s) and/or power to terminate to any of a variety of functionalities (e.g., animated functions, motors, lights) within the primary real object 70. For other effects, tubing or hose supplying water, fog, air, or any other fluid may also exist or be coupled (e.g., rigged) in parallel to the structural cable. It should be appreciated that similar or same support and/or special effect components may be provided for the secondary real object 66. Accordingly, the secondary real object 66 and/or the primary real object 70 may be animated to move, such as to move one portion relative to another portion.

Additionally, as described herein, the reflective component 72 may be a fully reflective material or a beam splitter. In one example, the attraction system 50 utilizing the fully reflective material may include the fully reflective material positioned to reflect the primary real object 70 to enable the guest(s) 54 to view the virtual object 64, which is the reflection of the primary real object 70. For example, the fully reflective material may be at an angle (e.g., at a 45-degree angle) with respect to a line of sight of the guest(s) 54. It should be noted that the angle of the reflective component 72 and/or other components (e.g., show set) may be any suitable angle and may be selected to produce an intended effect. Further, the fully reflective material may be glass, plastic, foil, and/or full-reflective mirror, that includes reflective properties to enable viewing the reflection of the primary real object 70 as the virtual object 64 and a full reflection of the primary area 68, thereby creating a virtual secondary area.

In an embodiment, the reflective component 72 may be a beam splitter that enables the guest(s) 54 to view the reflection of the primary real object 70 as the virtual object 64, as well as to view the secondary area 62 through the beam splitter. In this way, the beam splitter may visually combine the primary area 68 with the secondary area 62. For example, the guest(s) 54 may view the reflection of the primary real object 70 as the virtual object 64, which may provide an illusion of the primary real object 70 being present within the secondary area 62. The guest(s) 54 may simultaneously view the secondary real object 66 in the secondary area 62, as the secondary real object 66 is visible through the beam splitter. Further, the beam splitter may be glass, plastic, foil, and/or a semi-transparent mirror, that includes both transmissive and reflective properties to enable viewing the secondary real object 66 within the secondary area 62 through the beam splitter, as well as viewing the reflection of the primary real object 70 as the virtual object 64 within the secondary area 62 due to reflection of the primary real object 70 via the beam splitter. By way of example, the beam splitter may be at an angle (e.g., at a 45-degree angle) with respect to a line of sight of the guest(s) 54. It should be noted that the angle may be any suitable angle and may be selected to produce an intended effect.

The virtual object 64 in FIG. 1 is depicted with dashed lines to indicate that the virtual object 64 merely appears to the guest(s) 54 to be present in the secondary area 62 (e.g., a virtual secondary area), as the virtual object 64 is merely the reflection of the primary real object 70. In an embodiment, when the reflective component 72 is the fully reflective material, the secondary area 62 may be a full reflection of the primary area 68 as generated by the reflective component 72 that includes the fully reflective material, thereby creating the secondary area 62 as the virtual secondary area. In an embodiment, when the reflective component 72 is the beam splitter, the secondary area 62 may include the real secondary area that appears to be overlaid with or include the full reflection of the primary area 68 as generated by the reflective component 72 that includes the beam splitter. Accordingly, when the reflective component 72 is the beam splitter, visualization of the secondary real object 66 through the beam splitter and the virtual object 64 reflected by the beam splitter together (e.g., simultaneously) may provide a unique viewing experience for the guest(s) 54. As an example, the primary real object 70 in the primary area 68 may be adjusted to simulate an interaction between the secondary real object 66 and the virtual object 64 in the secondary area 62.

In any case, movement, adjustment, or any other alteration of the primary real object 70 in the primary area 68 may cause corresponding change in appearance of the virtual object 64 in the secondary area 62. Thus, the primary real object 70 may be adjusted to portray a more realistic appearance of the virtual object 64. Furthermore, in an embodiment, the virtual object 64 viewable by the guest(s) 54 may also include certain characteristics (e.g., properties, qualities). For example, the virtual object 64 may have a transparent or translucent appearance to the guest(s) 54. For example, when the reflective component 72 is the beam splitter, the secondary real object 66 and/or another physical object in the secondary area 62 provided at the real secondary area may appear to be visible through the virtual object 64. As such, the appearance of the virtual object 64 may be different than that of a direct view of the primary real object 70.

In an embodiment, a light source 76 may emit light toward the primary real object 70 in the primary area 68. Thus, the reflective component 72 may reflect the light (e.g., with the primary real object 70, such as to provide an illuminated primary real object 70) and/or to aid in simulating or providing the illusion of the primary real object 70 being present within the secondary area 62.

In addition, a special effects system 74 may be employed to provide the guest(s) 54 an immersive experience. As such, smoke/fire effect source 78 and/or actuated props 80 (e.g., show action equipment (SAE)) may be implemented and coordinated with movement of the primary real object 70, such as to provide effects as the primary real object 70 begins to decelerate. This provides a way to prevent the guest(s) 54 from viewing the primary real object 70 come to a full stop. For example, as the primary real object 70 begins to decelerate, the actuated props 80 may be deployed within the secondary area 62. For example, the actuated props 80 may include doors (e.g., show action doors), which may have any form and/or include any type of object (e.g., gate, panel) that may be actuated to close or to otherwise move to block the guest(s) 54 from viewing the primary real object 70, the primary area 68, and/or the secondary area 62. Additionally or alternatively, smoke effects and or fire effects may be provided by the smoke/fire effect source 78 (e.g., fire, atmospheric effects (e.g., water, fog, mist, wind, air flow, fog, smoke, liquid nitrogen ($LN_2$)). In an embodiment, such effects may be provided simultaneously with the movement of the actuated props 80. In one embodiment, the doors may be actuated to close, and the smoke effects may be employed together. In one embodiment, the doors may be actuated to close, and the fire effects may be employed together. The special effects system 74 may be timed according to the movement of the primary real object 70 to signal an end of a show, to provide a transition within the show, and/or to create an immersive experience for the guest(s) 54, for example. In one embodiment, the smoke/fire effect source 78 may provide effects in lieu of the actuated props 80, such as the doors, such that the effects occlude vision similar to an opaque material, thereby generating an effect and blocking view of the primary real object 70 utilizing atmospheric special effect methodologies.

Moreover, the show effect system 60 may include a control system 82 (e.g., an automation controller, a programmable logic controller, an electronic controller) configured to operate to adjust the experience provided to the guest(s) 54 via the show effect system 60. The control system 82 may include a memory 84 and processing circuitry 86. The memory 84 may include volatile memory, such as random-access memory (RAM), and/or non-volatile memory, such as read-only memory (ROM), optical drives, hard disc drives, solid-state drives, or any other non-transitory computer-readable medium that includes instructions. The processing circuitry 86 may be configured to execute such instructions. For example, the processing circuitry 86 may include one or more application specific integrated circuits (ASICs), one or more field programmable gate arrays (FPGAs), one or more general purpose processors, or any combination thereof.

In an embodiment, the control system 82 may be configured to adjust a positioning of the primary real object 70 in the primary area 68. By way of example, the primary real object 70 may be coupled to an actuator 88 (e.g., one or more actuators) configured to drive movement of the primary real object 70. The control system 82 may be communicatively coupled to the actuator 88 and may instruct the actuator 88 to move the primary real object 70, such as to position the primary real object 70 to a first position. The control system 82 may instruct the actuator 88 to drop the primary real object 70 to initiate its free fall, such as to initiate its free fall from the first position. The control system 82 may instruct the actuator 88 to apply brakes via a brake system 96 to slow or decelerate the primary real object 70, and to cause the primary real object 70 to stop at a second position. The control system 82 may instruct the actuator 88 to reset the primary real object 70 by returning the primary real object 70 to the first position (e.g., via the suspension assembly 94). The control system 82 may instruct the actuator 88 to animate and/or control aspects of the primary real object 70. For example, the control system 82 may instruct the actuator 88 to move certain parts of the primary real object 70 relative to other parts of the primary real object 70.

In an embodiment, the control system 82 may be configured to adjust a position of the secondary real object 66 in the secondary area 62. By way of example, the secondary real object 66 may be coupled to an actuator 90 (e.g., one or more actuators) configured to drive movement of the secondary real object 66. The control system 82 may be communicatively coupled to the actuator 90 and may instruct the actuator 90 to move the secondary real object 66 to a specific position (e.g., first position, second position). The control system 82 may instruct the actuator 90 to reset the secondary real object 66. The control system 82 may instruct the actuator 90 to animate and/or control aspects of the secondary real object 66. For example, the control system 82 may instruct the actuator 90 to move certain parts of the secondary real object 66 relative to other parts of the secondary real object 66.

In an embodiment, the control system 82 may be configured to receive signals indicative of a position of the ride vehicle 56 and/or drive movement of the ride vehicle 56 according to the timing of the show effect system 60. For example, the control system 82 may be communicatively coupled to the ride vehicle 56 and may instruct the ride vehicle to stop so the guest(s) 54 can view effects provided by the show effect system 60. The control system 82 may be communicatively coupled to the ride vehicle 56 and may instruct the ride vehicle 56 to move so the guest(s) 54 can continue through the rest of the attraction system 50.

In an embodiment, the control system 82 may be communicatively coupled to the special effects system 74 (e.g., light source 76, smoke/fire effect source 78, actuated props 80, and actuator 92). The control system 82 may instruct the light source 76 to adjust lighting with respect to the primary real object 70, the virtual object 64, and/or the secondary real object 66. In another example, the control system 82 may instruct the smoke/fire effect source 78 to turn on and be timed according to the movement (e.g., deceleration) of the primary real object 70. In an example, the control system 82 may be communicatively coupled to the actuator 92 of the actuated props 80 and be timed according to the movement (e.g., deceleration) of the primary real object 70. By way of example, the control system 82 may instruct doors to be actuated and close to cover or hide the scene within the secondary area 62. Similarly, the control system 82 may instruct doors to be actuated and reset the position of the doors such that they are open to uncover or expose the scene within the secondary area 62. Further, the control system 82 may instruct the special effects system 74 to begin the smoke/fire effect via the smoke/fire effect source 78 according to the movement (e.g., deceleration) of the primary real object 70.

Figure 2:
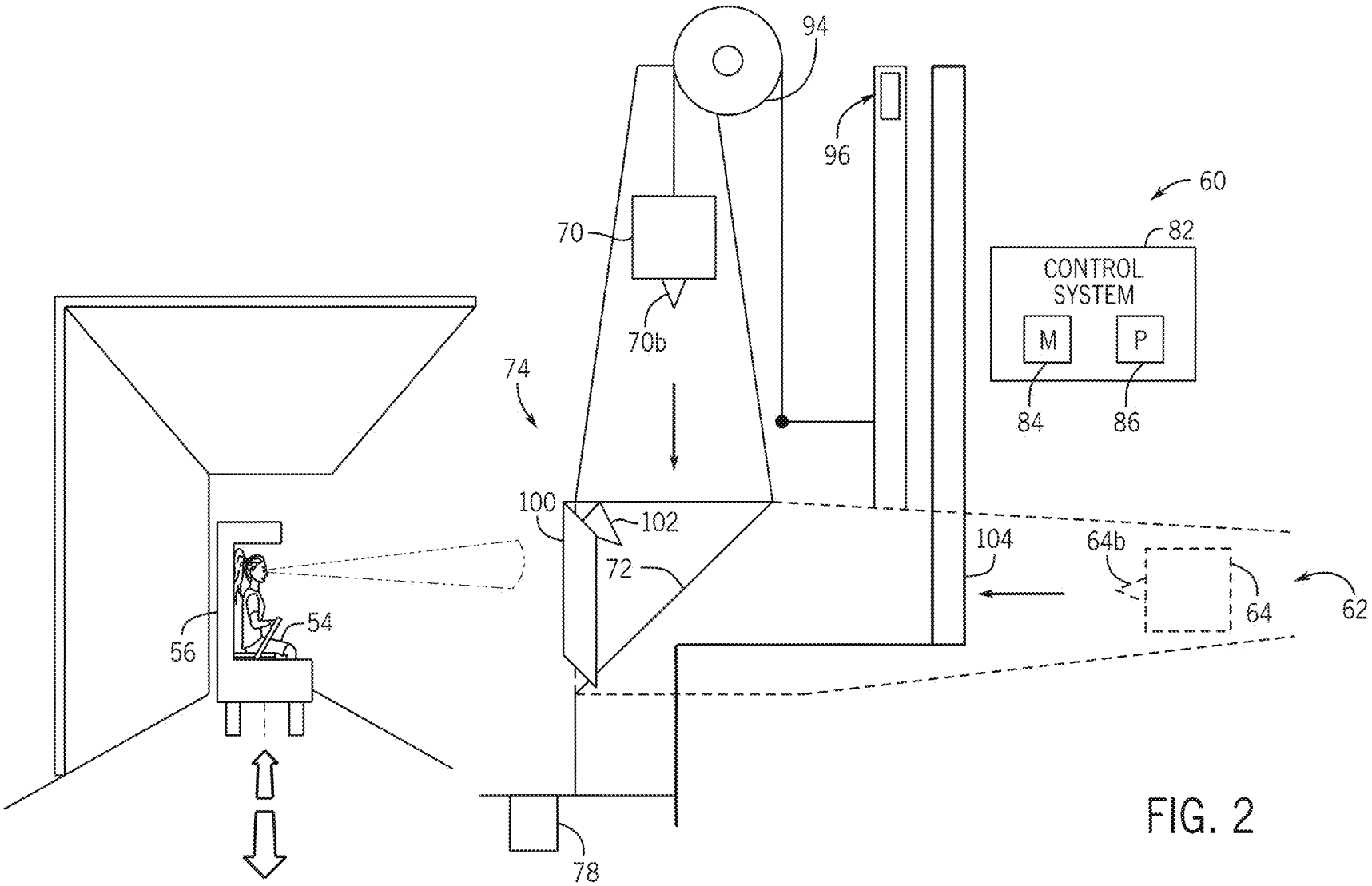
FIG. 2 is a cross-sectional side view of the attraction system of FIG. 1, wherein a primary real object is in a first position, in accordance with the embodiments described.

With the foregoing in mind, FIG. 2 illustrates a cross-sectional side view of an embodiment of the attraction system 50, wherein the primary real object 70 is in a first position (e.g., initial position) in the primary area 68. The show effect system 60 provides the reflection of the primary real object 70 in motion (e.g., in free fall, exhibits a velocity, accelerates). The show effect system 60 may suspend the primary real object 70 above the reflective component 72 using a suspension assembly 94. In FIG. 2, the reflective component 72 is the fully reflective material that reflects the primary real object 70 to create the virtual object 64 for the guest(s) 54, as well as reflects the primary area 68 to create a virtual representation or provide appearance of the secondary area 62 (e.g., the virtual secondary area).

The fully reflective material may be positioned at an angle (e.g., 45-degree angle) to reflect imagery of the primary real object 70 to create an illusion of the virtual object 64 in the secondary area 62 (e.g., the virtual secondary area) from a perspective of the guest(s) 54 in the observation area 52. Furthermore, as described herein, the fully reflective material generates the virtual secondary area, wherein the virtual secondary area is generated due to the reflection of the primary area 68 and contents within. As such, the virtual object 64 appears to be within the secondary area 62, which is merely the virtual secondary area in FIG. 2 as indicated by the secondary area 62 being in dashed lines and appearing to extend beyond one or more walls 104 (e.g., boundary, support structure). While the primary real object 70 is in the first position, the virtual object 64 may appear to be in a first position in the secondary area 62 (e.g., the virtual secondary area) (e.g., far away to the guest(s) 54, as portrayed in FIG. 2). Once the primary real object 70 is in motion, (e.g., in free fall, exhibits a velocity, accelerates), the virtual object 64 may also appear to be in motion (e.g., come or move towards the guest(s) 54) within the secondary area 62 (e.g., the virtual secondary area). Therefore, as the primary real object 70 falls, the virtual object 64 will appear to the guest(s) 54 as if it is coming toward the guest(s) 54 accordingly. It should be noted that the suspension assembly 94 will not be viewable by the guest(s) 54, as the mechanism and rigging associated with the primary real object 70 is behind the primary real object 70 (e.g., relative to the reflective component 72). Further, in FIG. 2, the reflective component 72 may reflect portions (e.g., surfaces, walls, show elements) of the primary area 68. For example, the primary area 68 may contain visuals (e.g., the primary scenery 71 of FIG. 1) that complement the primary real object 70 to create visuals for the guest(s) 54, thereby creating the virtual secondary area as the secondary area 62. Importantly, it should be noted that the angle of the fully reflective material and or the primary area 68 can be adjusted to create various immersive experiences for the guest(s) 54.

In the illustrated show effect system 60, the primary area 68 includes the primary real object 70 that is suspended vertically by the suspension assembly 94. In general, the primary area 68 may not be directly visible to the guest(s) 54 from the observation area 52. As such, the primary area 68 may be elevated and positioned over the reflective component 72. Positioning the primary area 68 above the fully reflective material allows for the reflection of the primary real object 70 to be reflected off the fully reflective material, creating the virtual object 64 that appears to be within the secondary area 62 (e.g., the virtual secondary area). The suspension assembly 94 may include a cable (e.g., rope, chain, linkage), and the cable may be extended and retracted via a pulley system. The control system 82 (e.g., including the memory 84 and the processing circuitry 86) controls the suspension assembly 94 to position the primary real object 70. For example, the control system 82 actuates the suspension assembly 94 to drop or actuate the primary real object 70. The primary real object 70 may be dropped using various techniques including but not limited to linear actuators, rotary switches, actuation, hydraulic, pneumatic, release of a braking mechanism 96 or other retainer, or alternative methods. In a further embodiment, the primary real object 70 may be actuated through electrical wiring. For example, the control system 82 can actuate the primary real object 70 to move or animate certain parts with respect to the theme of the attraction system 50 to create an immersive experience. In an embodiment, the primary real object 70 may be modified with additional props that may be utilized to create an immersive experience. For example, the primary real object 70 may be combined with or coupled to an additional primary real object 70*b*. As such, the guest(s) 54 may view a combination of the virtual object 64 and an additional virtual object 64*b*. Advantageously, the show effect system 60 may utilize a vertical space to provide the illusion of the primary real object 70 moving through a horizontal space (e.g., the virtual secondary area), which may enable use of compact structures for areas with limited floor space and, for example. For example, in the illustrated show effect system 60, the one or more walls 104 may be present within the attraction system 50, which indicates ability to use the show effect system 60 even in presence of limited space (e.g., space constraints) within the attraction system 50. As shown, the show effect system 60 may also include the special effect system 74 with actuated props (e.g., doors 100 and/or other physical props 102) and/or the smoke/fire effect source 78, and operation of such features is described with reference to FIG. 3.

Figure 3:
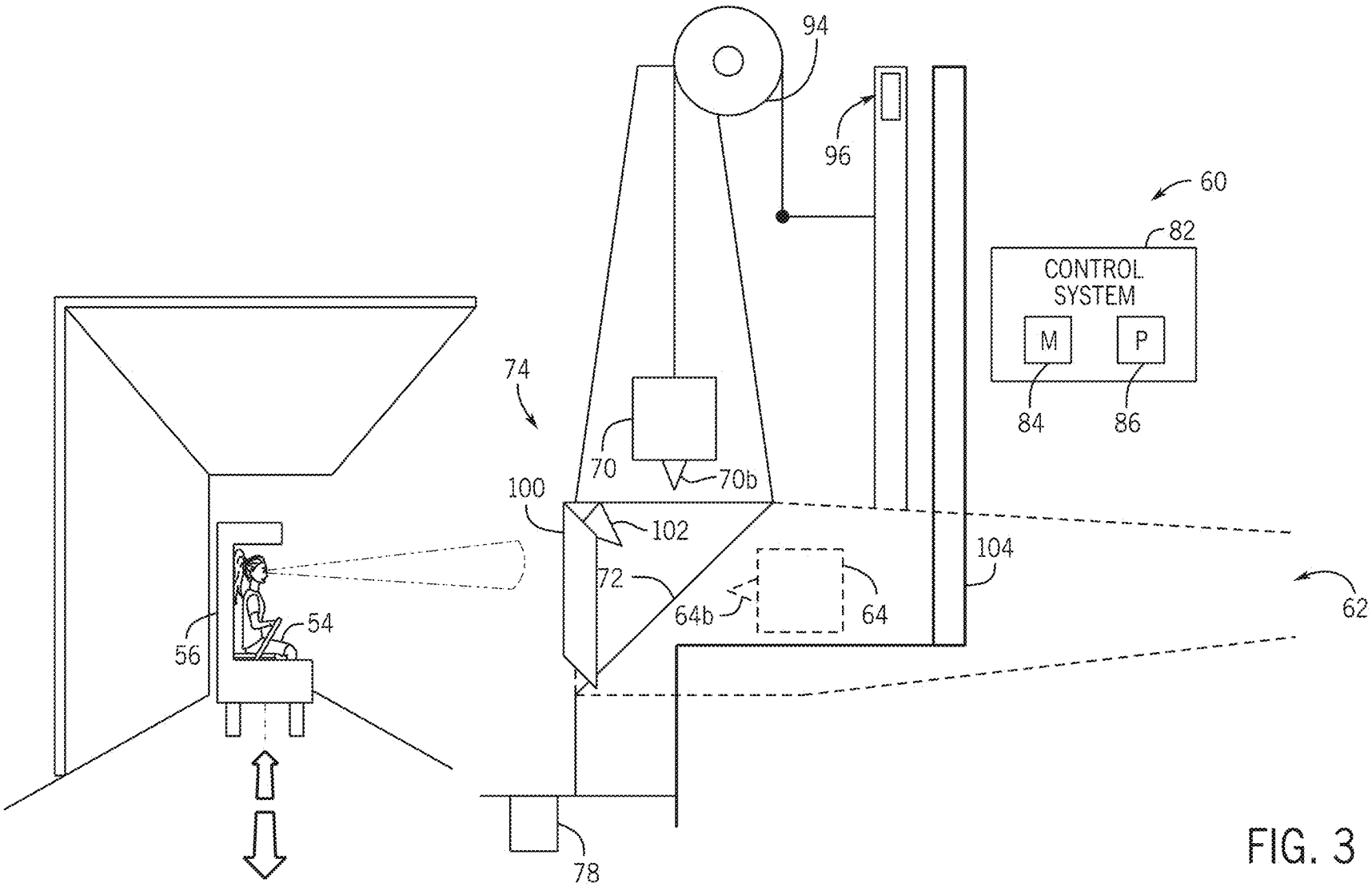
FIG. 3 is a cross-sectional side view of the attraction system of FIG. 2, wherein the primary real object is in a second position and a special effects system is implemented, in accordance with the embodiments described.

By way of example, FIG. 3 illustrates a cross-sectional side view of an embodiment of the attraction system 50 of FIG. 2, wherein the primary real object 70 is in a second position and the special effects system 74 is implemented. The show effect system 60 provides the reflection of the primary real object 70 in motion (e.g., in free fall, exhibits a velocity, accelerates). FIG. 3 demonstrates that when the primary real object 70 is in the second position, the virtual object 64 may appear to be in a second position in the secondary area 62 (e.g., the virtual secondary area) (e.g., closer to the guest(s) 54).

The control system 82 may begin deceleration of the primary real object 70 by activating the braking mechanism 96, as demonstrated in FIG. 3. The free fall of the primary real object 70 can be stopped using deceleration techniques including, but not limited to fin brakes, eddy current brakes, and/or magnetic brakes. It should be noted that the control system 82 will stop the motion of the primary real object 70 before the primary real object 70 reaches the reflective component 72 and/or before the primary real object 70 is in the line of the sight of the guest(s) 54.

Furthermore, it is important to note that the special effects system 74 of FIG. 1 may be employed within the show effect system 60. For example, the smoke/fire effect source 78 may be included as a part of the show effect system 60. The smoke/fire effect source 78 (e.g., fire, atmospheric effects (e.g., water, fog, mist, wind, air flow, fog, smoke, $LN_2$) may be timed according to the deceleration of the primary real object 70. In this way, the guest(s) 54 may not view the virtual object 64 (e.g., reflection of the primary real object 70) in the secondary area 62 come to a complete halt as the braking mechanism 96 stops the primary real object 70. Additionally or alternatively, the actuated props 80 of FIG. 1 (e.g., doors 100 and/or the other physical props 102) may be actuated to close and be timed according to the deceleration of the primary real object 70. In this way, the actuated props 80 may block the guest(s) 54 from viewing the primary real object 70 as the primary real object 70 decelerates. Furthermore, the other physical props 102 may be utilized to create an immersive experience. For example, the reflective component 72 may reflect the primary real object 70 and the additional primary real object 70*b* to create the virtual object 64 and the additional virtual object 64*b*. Accordingly, certain features of the primary real object 70*b* and/or the additional virtual object 64*b* may be represented by the physical prop 102. As the primary real object 70 and the additional primary real object 70*b* begins decelerating, the physical prop 102 may be actuated to extend through the doors 100 to provide an effect as if the additional virtual object 64*b* is extending through the doors 100 (e.g., crashing through the doors 100).

Figure 4:
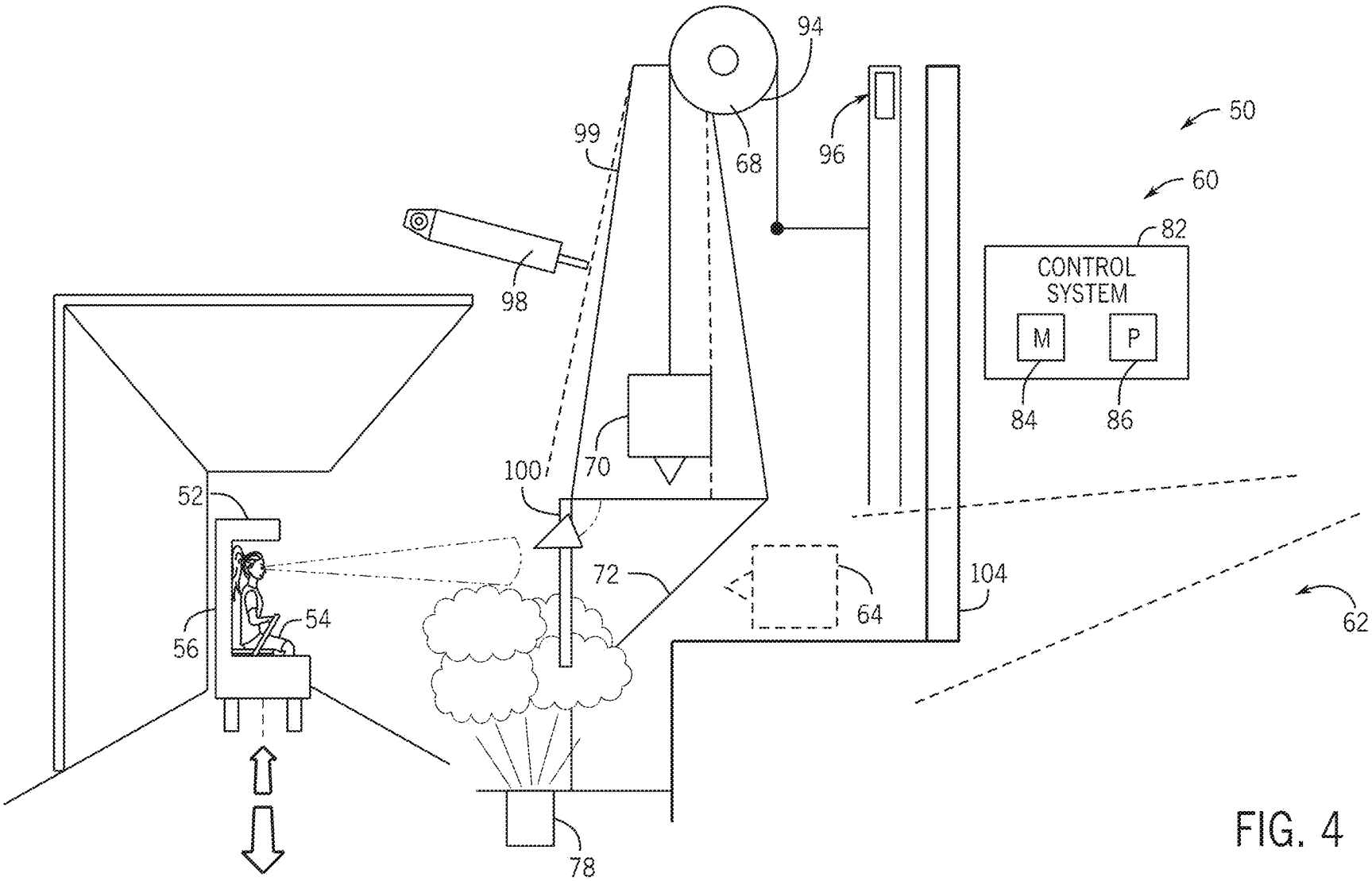
FIG. 4 is a cross-sectional side view of the attraction system of FIG. 1, wherein a primary area is actuated, in accordance with the embodiments described.

With the foregoing in mind, FIG. 4 illustrates a cross-sectional side view of an embodiment of the attraction system 50, wherein the primary area 68 is actuated. The show effect system 60 provides the reflection of the primary real object 70 in motion, (e.g., in free fall, exhibits a velocity, accelerates). FIG. 4 demonstrates that when the primary area 68 is coupled to an actuator 98, the actuator 98 can independently move the primary area 68 (e.g., move the walls and/or the primary scenery 71 within the primary area 68, as shown in FIG. 1) as the primary real object 70 is in motion, (e.g., in free fall, exhibits a velocity, accelerates). For example, the actuator 98 may independently move walls 99 of the primary area 68, wherein the walls 99 are arranged to form a space (e.g., chamber) and the primary real object 70 moves through the space as described herein.

The control system 82 may be communicatively coupled to the actuator 98. As such, the control system 82 activates the actuator 98 and causes the primary area 68 to move (e.g., tilt side-to-side relative to the observation area 52, tilt front-to-back toward and away from the observation area 52, move vertically, shake, vibrate), which may occur concomitantly as the primary real object 70 in free fall. Accordingly, the reflective component 72 reflects imagery including a combination of the primary real object 70 in motion and the actuated primary area 68 to create the virtual object 64 for the guest(s) 54, as well as the actuated primary area 68 to create a virtual representation or provide appearance of an actuated secondary area 62. The combination of the primary real object 70 in motion and the actuated primary area 68 creates imagery wherein the virtual object 64 and secondary area 62 may appear more dynamic, creating an immersive experience for the guest(s) 54.

Figure 5:
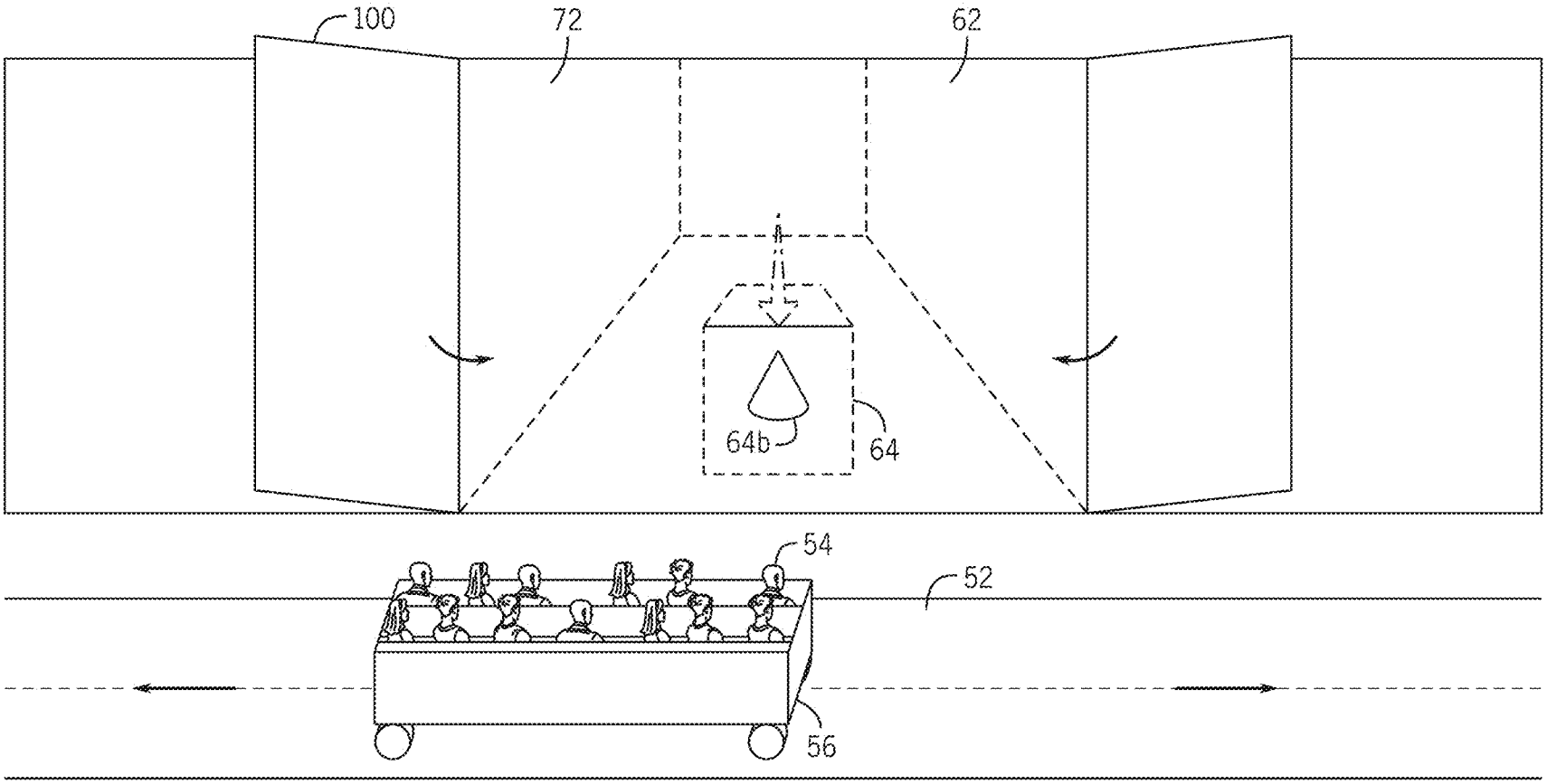
FIG. 5 is a front view of the attraction system of FIG. 1, wherein a reflective component reflects imagery of a primary real object in motion to create a virtual object in motion, in accordance with the embodiments described herein.
Figure 6:
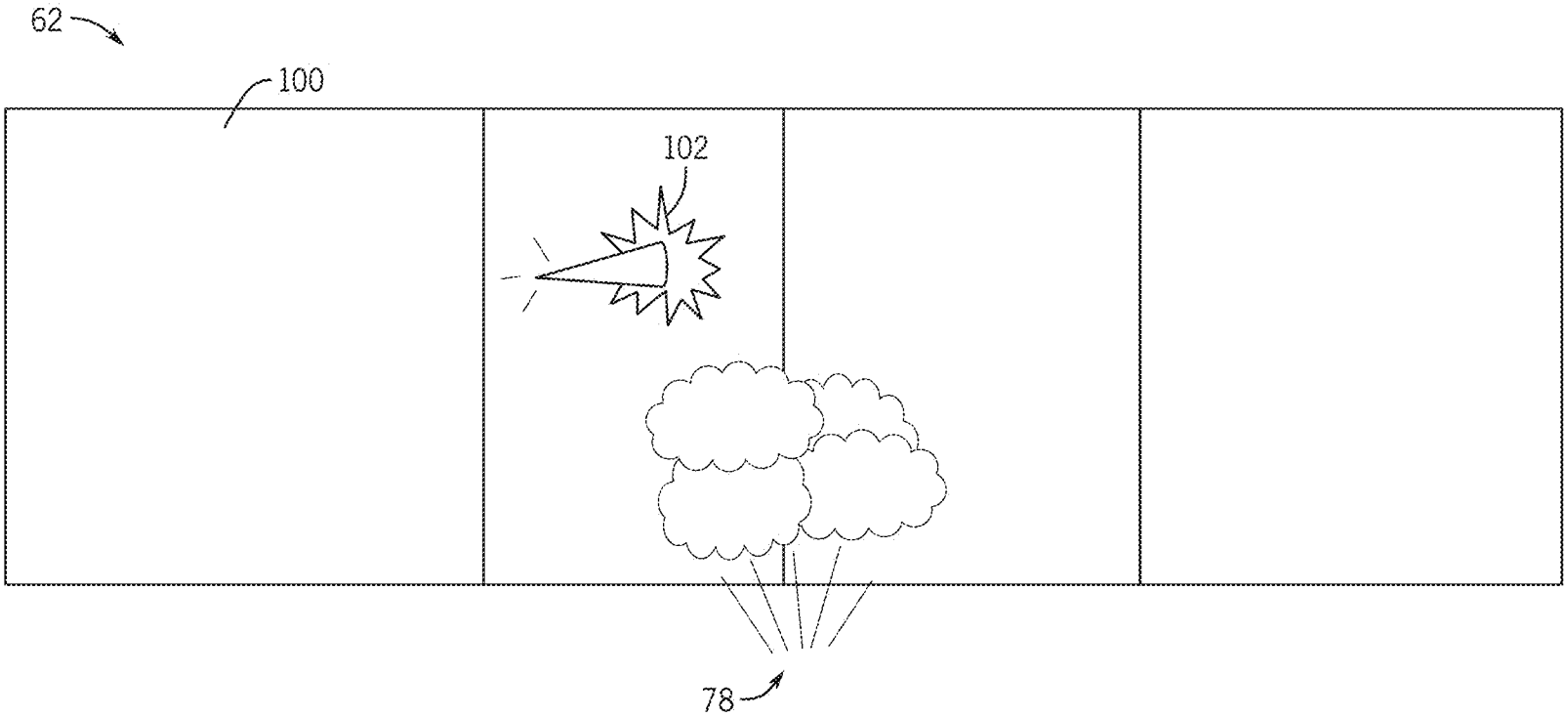
FIG. 6 is a front elevation view of the attraction system of FIG. 5, wherein a special effects system is employed to conclude a show, in accordance with the embodiments described herein.

With the preceding in mind and with reference to features shown in FIGS. 1-4, FIG. 5 illustrates a front view of the attraction system 50 (FIGS. 1-4), wherein the reflective component 72 reflects imagery of the primary real object 70 (FIGS. 1-4) in motion to create the virtual object 64 in motion for the guest(s) 54 (FIGS. 1-4). Once the primary real object 70 with the additional primary real object 70*b* is in motion, the virtual object 64 and the additional virtual object 64*b* (i.e., reflection of the primary real object 70 and the additional primary real object 70*b*) may also appear to be in motion (e.g., come or move toward the guest(s) 54 within in the observation area 52) within the secondary area 62. FIG. 5 demonstrates that as the primary real object 70 moves, the virtual object 64 will appear to the guest(s) 54 as if it is coming or moving toward the guest(s) 54.

In FIG. 5, the reflective component 72 is shown as the fully reflective material that reflects the primary real object 70 and the primary area 68 (FIGS. 1-4) to create the illusion of the virtual object 64 in the secondary area 62. It should be noted that the fully reflective material may reflect the primary scenery 71 (FIG. 1) of the primary area 68 as well, which may act as or create the illusion of the secondary area 62 (e.g., the virtual secondary area). Alternatively, as described herein at least with respect to FIGS. 1 and 7, the reflective component 72 may be a beam splitter to reflect imagery of the primary real object 70 in motion, creating the virtual object 64 for the guest(s) 54 to view within the secondary area 62 (e.g., the real secondary area) that is a present in a real-world environment. In this way, the beam splitter may allow the guest(s) 54 to view the secondary area 62 through the beam splitter.

With the preceding in mind and with reference to features shown in FIGS. 1-5, FIG. 6 illustrates a front elevation view of the attraction system 50 (FIGS. 1-4), wherein a special effects system 74 (FIG. 1) is employed to conclude a show or a show sequence as part of a scene. As the primary real object 70 (FIGS. 1-4) begins to decelerate, the special effects system 74 may be activated. For example, the control system 82 (FIGS. 1-4) may activate the actuated props 80 (FIG. 1), such as the doors 100, to close and be timed with respect to the deceleration of the primary real object 70, blocking (e.g., preventing) the guest(s) 54 (FIGS. 1-4) from viewing the primary real object 70 (e.g., at an end of its path of travel) and also from viewing the reflection of the primary real object 70 and the primary area 68 (e.g., from viewing the secondary area 62 (FIGS. 1-5)). The control system 82 may activate the smoke/fire effect source 78 and coordinate the timing of smoke/fire effect provided by the smoke/fire effect source 78 with the deceleration of the primary real object 70. Further, additional actuated props 80 may be implemented to create an immersive experience. For example, once the doors 100 have closed, physical props 102 may extend (e.g., burst, move) through doors 100. The control system 82 may actuate the one or more physical props 102 at a specific time to extend through the doors 100 once the doors 100 close. The type of physical prop 102 employed may complement a theme and/or shape of the primary real object 70 and the virtual object 64 (FIGS. 1-5). For example, if the primary real object 70 includes an animated character with a first portion (e.g., a body portion, such as a hooved foot; a handled object, such as a sword; an object, such as a rock; light fixtures, such as a light bulb), the physical prop 102 may correspond to or represent the first portion so as to provide an effect of the first portion contacting and extending through the doors 100 (e.g., door, screen, frosted glass, beaded curtain).

Figure 7:
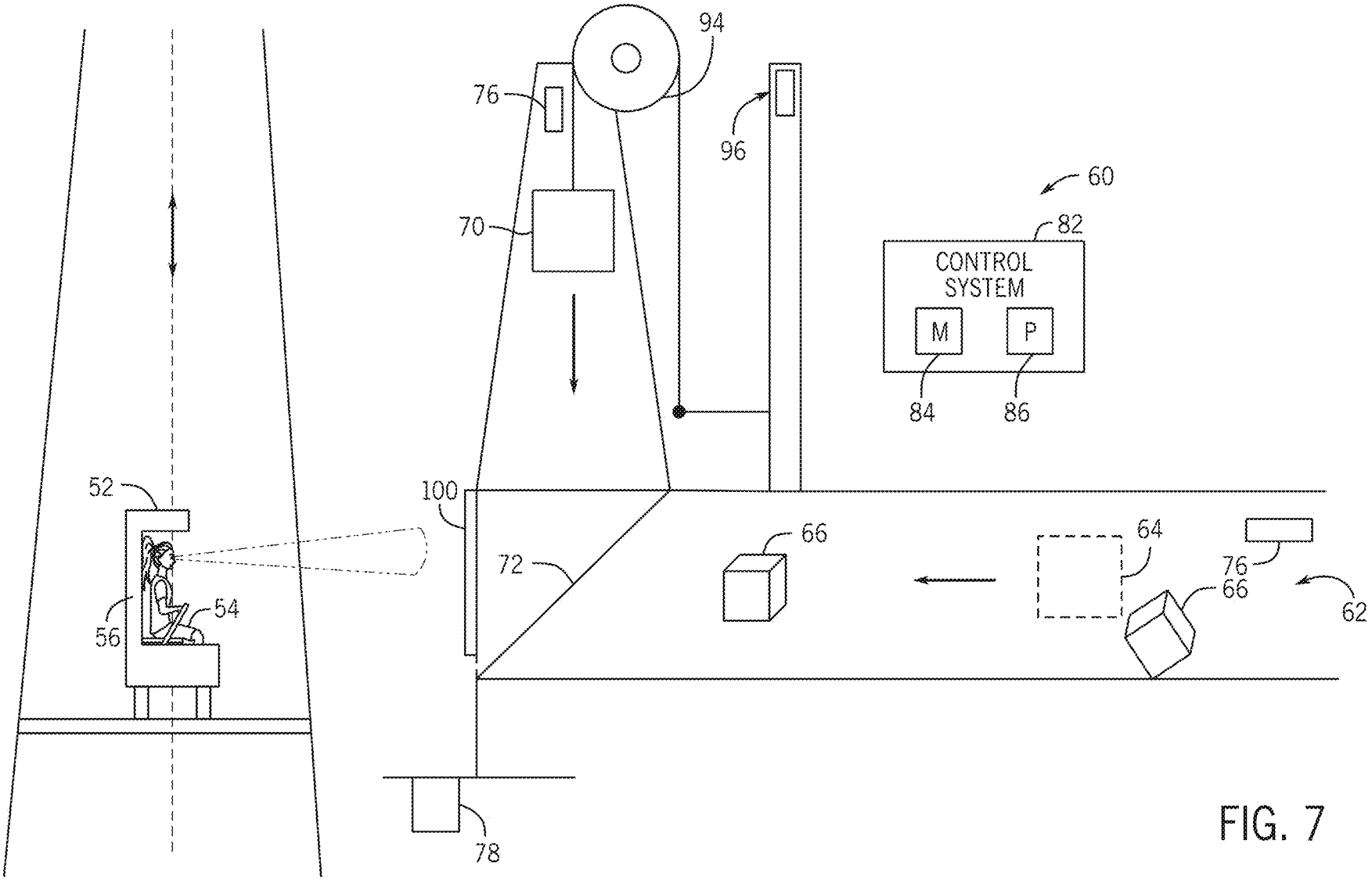
FIG. 7 is a cross-sectional side view of the attraction system of FIG. 1, wherein a beam splitter enables a guest(s) to view a combination of a primary area and a secondary area, in accordance with the embodiments described.

With the foregoing in mind, FIG. 7 illustrates a cross-sectional side view of the attraction system 50, wherein the reflective component 72 is a beam splitter that enables the guest(s) 54 to view a combination of the primary area 68 and the secondary area 62 that is present in the real-world environment. For clarity, in discussion of FIG. 7, the reflective component 72 is referred to as "the beam splitter." The show effect system 60 provides the reflection of the primary real object 70 in motion (e.g., in free fall). The show effect system 60 may suspend the primary real object 70 above the beam splitter using the suspension assembly 94. In FIG. 7, the beam splitter reflects the primary real object 70 to create the virtual object 64 for the guest(s) 54, as well as enables the guest(s) 54 to view secondary real objects 66 in the secondary area 62 through the beam splitter. The beam splitter accordingly combines the primary area 69 with the secondary area 62 for visualization by the guest(s) 54.

The beam splitter may be positioned at an angle (e.g., 45-degree angle) to reflect imagery of the primary real object 70 to create the virtual object 64 in the secondary area 62 from a perspective of the guest(s) 54 in the observation area 52. While the primary real object 70 is in the first position, the virtual object 64 may appear to be in a first position in the secondary area 62 (e.g., far away from the guest(s) 54). Once the primary real object 70 is in motion (e.g., in free fall), the virtual object 64 may also appear to be in motion (e.g., come or move toward the guest(s) 54) within the secondary area 62. The guest(s) 54 may also view the secondary real objects 66 within the secondary area 62 through the beam splitter.

Concomitantly, and with reference to FIG. 1, the special effects system 74 (FIG. 1) may be employed to create an immersive experience for the guest(s) 54. The light source 76 (FIG. 1) may be utilized to realistically portray the primary real object 70 as present when interacting with secondary real objects 66 within the secondary area 62. For example, theatrical lighting fixtures may be utilized that illuminate any practical area that may be viewable by guest(s) 54. Further, the secondary real objects 66 may be actuated by the control system 82 and timed with respect to the movement of the primary real object 70 in motion. For example, as the primary real object 70 is in free fall, the secondary real object 66 may be actuated to move into the direction of travel of the virtual object 64 as viewed by guest(s) 54. Therefore, as the primary real object 70 falls, the virtual object 64 will appear to the guest(s) 54 as if it is interacting with secondary real object 66 in the secondary area. For example, the virtual object 64 may pass through solid objects (e.g., the secondary real object 66) within the secondary area 62 from the perspective of the guest(s) 54. It should be noted that the primary area 68 and/or the secondary area 62 may contain visuals (e.g., the primary scenery 71 of FIG. 1) that complement the primary real object 70 and the secondary real object 66 to create visual effects for the guest(s) 54. It should be appreciated that and suitable number of secondary real objects 66 may be provided in the secondary area 62, such as one, two, three, four or more. Further, the secondary real objects 66 may include any suitable geometry (e.g., size, shape).

The control system 82 (e.g., including the memory 84 and the processing circuitry 86) controls the suspension assembly 94 to position the primary real object 70 and the secondary real object 66. For example, the control system 82 actuates the suspension assembly 94 to drop the primary real object 70. In a further embodiment, the secondary real object 66 may be actuated through electrical wiring. For example, the control system 82 can actuate the secondary real object 66 to move or animate certain parts with respect to the theme of the attraction system 50 to create an immersive experience.

Figure 8:
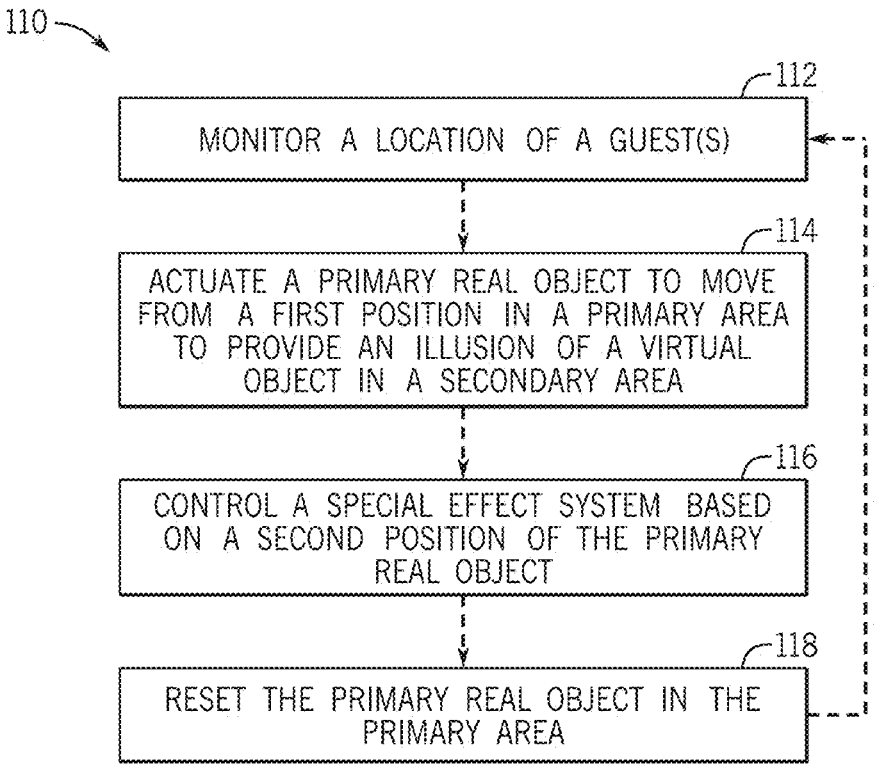
FIG. 8 is a flow diagram of a method for operating an attraction system, in accordance with the embodiments described herein.

With the foregoing in mind, FIG. 8 is a flow chart of a method 110 for operating an attraction system, such as the attraction system 50 of FIG. 1. The method 110 includes various steps represented by blocks. It should be noted that at least some steps of the method 110 may be performed as an automated procedure by a processing system, such as the control system 82 of FIG. 1. Although the flow chart illustrates the steps in a certain sequence, it should be understood that the steps may be performed in any suitable order and certain steps may be carried out simultaneously, where appropriate. Additionally, steps may be added to or omitted from the method 110.

The method 110 may include, at block 112, the control system monitoring a location of a guest(s), such as via monitoring the guest(s) as they move through an attraction by walking along a path, being carried along a conveyor, or being carried by a ride vehicle. For example, one or more sensors (e.g., cameras, position sensors) may provide sensor signals to the control system, and/or timing control signals may coordinate operation and provide indications of the location of the guest(s). In an embodiment with the guest(s) are carried by the conveyor or the ride vehicle, the control system may instruct the conveyor or the ride vehicle to stop when the guest(s) reach an observation area.

At block 114, the control system actuates (e.g., drops) a primary real object to move (e.g., free fall, accelerate) from a first position in a primary area, wherein a reflective component provides an illusion of a virtual object in a secondary area. As described herein, the reflective component may be a fully reflective material that provides a virtual representation of the secondary area (e.g., a virtual secondary area) or may be a beam splitter that enables visualization of the secondary area (e.g., a real secondary area) that is present in a real-world environment.

Further, at block 116, the control system may control a special effects system based on a second position of the primary real object (e.g., in response to the primary real object reaching or approaching a second position in the primary area). The special effects system may be communicatively coupled to the control system, wherein the control system may instruct the smoke/fire effect source to turn on and be timed as the primary real object reaches or approaches the second position. The control system may further instruct movement of actuated props to be timed as the primary real object reaches or approaches the second position. At block 118, the control system resets the primary real object (e.g., returns the primary real object from the second position to the first position) in the primary area, such that the primary real object is set to provide another show to a subsequent guest(s), for example.

While only certain features of the disclosure have been illustrated and described herein, many modifications and changes will occur to those skilled in the art. For example, while one primary real object is shown in a primary area, it should be appreciated that any suitable number of primary real objects may be provided and may move separately through the primary area (e.g., via separate suspension systems) to provide various visual effects. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An attraction system of an amusement park, the attraction system comprising:

an observation area;

a primary area;

a primary real object vertically suspended in the primary area via a suspension system; and a reflective component, wherein the reflective component is angled to reflect the primary real object to provide an illusion of a virtual object in a secondary area from a perspective of one or more guests in the observation area.

2. The attraction system of claim 1, comprising a control system configured to:

instruct the suspension system to release the primary real object in the primary area to enable the primary real object to accelerate in the primary area toward the reflective component to provide the illusion of the virtual object in motion in the secondary area.

3. The attraction system of claim 2, wherein the observation area, the primary area, and the reflective component are arranged such that the primary real object accelerating in the primary area provides the illusion of the virtual object moving in the secondary area toward the one or more guests in the observation area.

4. The attraction system of claim 1, wherein the primary area is positioned vertically above the reflective component.

5. The attraction system of claim 1, wherein the reflective component is a beam splitter to provide the secondary area as a real secondary area or a fully reflective material to provide the secondary area as a virtual secondary area via reflection of scenery in the primary area.

6. The attraction system of claim 1, wherein the reflective component is a beam splitter, the secondary area is a real secondary area, the attraction system comprises a secondary real object in the real secondary area, and the reflective component is angled to enable the one or more guests in the observation area to view the secondary real object in the real secondary area through the reflective component.

7. The attraction system of claim 6, comprising a lighting system configured to illuminate the primary real object to simulate interaction between the virtual object and the secondary real object in the real secondary area.

8. The attraction system of claim 1, comprising one or more actuated objects, and a control system configured to:

instruct the one or more actuated objects to move from an open configuration to a closed configuration in response to the primary real object reaching or approaching an end position in the primary area to block visualization of the primary real object by the one or more guests in the observation area.

9. The attraction system of claim 8, comprising a physical prop, wherein the control system is configured to:

instruct the physical prop to extend through the one or more actuated objects in the closed configuration to simulate the primary real object impacting the one or more objects.

10. The attraction system of claim 1, comprising a special effects system, and a control system configured to:

instruct the special effects system to provide at least one of a light, sound, smoke, fire, or atmospheric effect in response to the primary real object reaching or approaching an end position in the primary area to block visualization of the primary real object by the one or more guests in the observation area.

11. The attraction system of claim 1, wherein the primary real object comprises an animated character, and a control system is configured to actuate the animated character to cause one portion of the animated character to move relative to another portion of the animated character.

12. The attraction system of claim 1, wherein:

the primary area comprises:

walls that define a chamber; and the primary real object suspended in the chamber; and the walls comprise decorative elements that portray scenery.

13. An attraction system of an amusement park, the attraction system comprising:

a reflective component;

a primary area positioned vertically above the reflective component;

a primary real object positioned in the primary area; and a control system configured to instruct actuation of the primary real object in the primary area to enable the primary real object to accelerate in the primary area toward the reflective component to provide an illusion of a virtual object in motion in a secondary area from a perspective of one or more guests in an observation area.

14. The attraction system of claim 13, wherein the reflective component is a beam splitter to provide the secondary area as a real secondary area or a fully reflective material to provide the secondary area as a virtual secondary area via reflection of scenery in the primary area.

15. The attraction system of claim 13, wherein the reflective component is a beam splitter, the secondary area is a real secondary area, the attraction system comprises a secondary real object in the real secondary area, and the reflective component enables the one or more guests in the observation area to view the secondary real object in the real secondary area through the reflective component.

16. The attraction system of claim 13, comprising one or more actuated props, one or more special effects, or both, and wherein the control system is configured to:

initiate the one or more actuated props, the one or more special effects, or both in response to the primary real object reaching or approaching an end position in the primary area to block visualization of the primary real object by the one or more guests in the observation area.

17. A method of operating an attraction system, the method comprising:

operating, via a control system, a suspension system to release a primary real object to cause the primary real object to accelerate due to gravity from a first position in a primary area toward a second position in the primary area; and generating, via a reflective component, a reflection of the primary real object as the primary real object accelerates due to gravity from the first position in the primary area toward the second position in the primary area to provide an illusion of a virtual object in motion in a secondary area from a perspective of one or more guests in an observation area.

18. The method of claim 17, comprising:

operating, via the control system and in response to the primary real object reaching the second position in the primary area, the suspension system to reset the primary real object to cause the primary real object to return from the second position in the primary area to the first position in the primary area.

19. The method of claim 17, comprising:

initiating, via the control system, one or more actuated props, one or more special effects, or both in response to the primary real object reaching or approaching the second position in the primary area to occlude the primary real object from the perspective of the one or more guests in the observation area.

20. The method of claim 17, comprising:

driving, via the control system, movement of a secondary real object in the secondary area to enable simultaneous visualization of the illusion of the virtual object in motion in the secondary area and the movement of the secondary real object in the secondary area from the perspective of the one or more guests in the observation area.

* * * * *